US012624908B2

(12) United States Patent
Zoli

(10) Patent No.: US 12,624,908 B2
(45) **Date of Patent: *May 12, 2026**

(54) BREAK-BARREL FIREARM

(71) Applicant: ZOLI ANTONIO S.r.l., Gardone val Trompia (IT)

(72) Inventor: Paolo Zoli, Gardone val Trompia (IT)

(73) Assignee: ZOLI ANTONIO S.R.L., Gardone val Trompia (IT)

( * ) Notice: Subject to any disclaimer, the term of this patent is extended or adjusted under 35 U.S.C. 154(b) by 0 days.

This patent is subject to a terminal disclaimer.

(21) Appl. No.: 18/961,678

(22) Filed: Nov. 27, 2024

(65) Prior Publication Data

US 2025/0180312 A1 Jun. 5, 2025

(30) Foreign Application Priority Data

Dec. 1, 2023 (EP) ..... 23425064

(51) Int. Cl.
*F41A 3/58* (2006.01)
*F41A 3/64* (2006.01)
*F41C 7/11* (2006.01)

(52) U.S. Cl.
CPC ..... *F41A 3/64* (2013.01); *F41A 3/58* (2013.01); *F41C 7/11* (2013.01)

(58) Field of Classification Search
CPC ..... F41A 3/58; F41A 15/06; F41C 7/11
See application file for complete search history.

(56) References Cited

U.S. PATENT DOCUMENTS 363,577 A * 5/1887 Berg et al. ..... F41A 3/58 42/41
369,437 A * 9/1887 Dickerman ..... F41A 3/58 42/44

(Continued)

FOREIGN PATENT DOCUMENTS

BE 454137 A 2/1944
BE 841628 A * 9/1976

(Continued)

OTHER PUBLICATIONS

Extended European Search Report, European Patent Application No. 23425064.5 dated May 27, 2024, 5 pages.

*Primary Examiner* — Gabriel J. Klein
(74) *Attorney, Agent, or Firm* — Leber IP Law; Celia H. Leber

(57) ABSTRACT

The present invention concerns a firearm comprising at least one frame; and a barrel group comprising at least one barrel, the barrel group being mounted in a tilting manner with respect to the frame, wherein the frame houses at least one closing device configured to act between the frame and the barrel group so as to selectively prevent the frame of the barrel group from tilting with respect to the frame, and is characterized in that the closing device comprises at least one pair of clamping elements with longitudinal development independent of each other, the clamping elements being slidably housed inside the frame, each along its own longitudinal development axis; and at least one pair of buffers each coupled to a respective clamping element so as to exert an axial thrust force on the respective clamping element substantially in parallel to and/or substantially along the respective longitudinal development axis.

11 Claims, 11 Drawing Sheets

(56) References Cited

U.S. PATENT DOCUMENTS 395,849 A * 1/1889 Parry ..... F41A 3/58 42/44
574,409 A * 1/1897 Fyrberg ..... F41A 3/58 42/44
847,564 A * 3/1907 Fittipaldi et al. ..... F41A 3/58 42/44
1,137,045 A * 4/1915 Barnes ..... F41A 3/58 42/44
1,790,612 A * 1/1931 Frommer ..... F15B 13/04 42/44
2,095,297 A * 10/1937 Stiennon ..... F41A 3/58 42/44
2,603,021 A * 7/1952 Paulve ..... F41A 15/06 42/44
3,636,646 A * 1/1972 Drevet ..... F41A 19/19 42/44
3,800,455 A * 4/1974 Drevet ..... F41A 3/58 42/42.01
3,949,507 A * 4/1976 Hutton ..... F41A 3/58 42/44
4,000,575 A * 1/1977 Ruger ..... F41A 3/58 42/44
4,646,459 A * 3/1987 Brass ..... F41A 15/06 42/47
2015/0020424 A1 1/2015 Gentilini et al.

FOREIGN PATENT DOCUMENTS

BE 846522 A * 1/1977
FR 2934363 A3 * 1/2010 ..... F41A 3/58
WO WO-2006046094 A1 * 5/2006 ..... F41A 3/58

* cited by examiner

BREAK-BARREL FIREARM

RELATED APPLICATION

This application claims priority from European Patent Application No. 23425064.5, filed Dec. 1, 2023, the entire disclosure of which is incorporated herein by reference.

TECHNICAL FIELD

The present invention concerns in general a firearm with a break-barrel group, in particular a long firearm, such as a rifle, with a closing device suitable for preventing the barrel group from tilting.

BACKGROUND

"Rifle" type firearms have been around for decades in many different forms and types. Various types of rifle have been developed for many types of shooting. For example, and without limitations, there are single-shot shotguns, double-barrelled shotguns (double shotgun), over/under shotguns, bolt-action shotguns, semi-automatic shotguns, and so on. Technology continues to evolve to meet the diverse needs of the shooting enthusiasts. Many factors are taken into account in the design of single- or double-barrelled rifles, including appearance, weight, sensitivity, ease of use, end-use, and individual shooter's preferences.

In the single- and multi-barrelled rifles, a break-barrel group is generally provided to allow the extraction of casings as well as the refilling of new cartridges. In such firearms, therefore, there is typically also a closing device that has the function of allowing or preventing the barrel group of the firearm from tilting with respect to the body of the rifle, also known as the "frame".

Typically, the closing devices are positioned inside the firearm except for an actuation element, generally known as an opening lever or "lever", i.e. a manual mechanical member that protrudes outwards to be actuated by the user. Typical closing devices of the state of the art include the longitudinally moved latch, the transversely moved bolt and the longitudinally moved bolt.

The externally operable actuation elements are generally configured to move the latch or the bolt, as the case may be, between a release position in which the tilting of the barrel group is not hindered and a locking position in which such tilting is prevented. Typically, in the locking position, the bolt or the latch protrudes at least partially from the rifle body to engage corresponding shapings made on the barrels. In the release position, the bolt or the latch is retracted inside the rifle body, not engaging the barrels, which are thus free to tilt with respect to said rifle body.

The known closing devices have a number of unresolved disadvantages. In particular, the complexity of the known closing devices provided with elastic elements that work off-axis, typically leads to movements of the latch or bolt that are not completely linear or completely balanced, resulting in a high degree of wear.

Last but not least, the known closing devices are characterized by a certain structural complexity that makes their assembly on the frame body laborious and scarcely automatable.

SUMMARY OF THE INVENTION

In light of the above, the problem underlying the present invention is to devise a firearm with a break-barrel group that can be controlled to open and close effectively and functionally.

Within the scope of this problem, an object of the present invention is to make a firearm with a break-barrel group whose closing device is particularly reliable.

A further object of the present invention is to study a firearm with a break-barrel group whose closing device is poorly subject to wear and has a longer life cycle than the state of the art.

Yet another object of the present invention is to design a firearm with a break-barrel group that is versatilely actuatable and adaptable to a plurality of actuation elements.

In accordance with a first aspect thereof, the invention therefore concerns a firearm comprising at least one frame and a barrel group, wherein the barrel group comprises at least one barrel and is mounted in a tilting manner with respect to the frame. The frame houses at least one closing device configured to act between the frame and the barrel group so as to selectively prevent the barrel group from tilting with respect to the frame.

According to the present invention the closing device comprises:

- at least one pair of clamping elements with longitudinal development independent of each other, the clamping elements being slidably housed within the frame, each along its own longitudinal development axis; and
- at least one pair of buffers each coupled to a respective clamping element so as to exert an axial thrust force on the respective clamping element substantially in parallel to and/or substantially along the respective longitudinal development axis.

The Applicant has identified that by making the closing device with a pair of mutually independent clamping elements, each associated with a respective buffer capable of exerting an axial thrust force in parallel to and/or substantially along the development axis of the respective closing element, it is possible to considerably reduce the wear of both clamping element itself and of the seat in which it is housed.

The Applicant has therefore studied a solution which, despite its only apparent simplicity, is able to reliably maintain the firearm in its own closed configuration. At the same time, the particular closing device studied by the Applicant allows a return to the open configuration in an effective and functional manner.

Last but not least, the elements that make up the closing device have a structure that can be advantageously actuated in a versatile manner through actuation elements of different types, such as a rotatable lever or a translatable slider.

The present invention may have at least one of the preferred following features; the latter may in particular be combined with one another as desired in order to meet specific application needs.

In a variant of the invention, each buffer of the pair of buffers comprises a support carrying a first elastic element interposed between the support and a respective clamping element, wherein optionally the support comprises a first shank shaped to carry and/or cooperate with the respective first elastic element in exerting the axial thrust force and a second shank shaped to achieve a stable coupling to the frame.

In a variant of the invention, each buffer of the pair of buffers is mounted on a respective side of a rear portion of the frame.

Advantageously, the specific construction of the support of the buffer and its particular positioning facilitate mounting the buffer on the frame, thus making it possible to easily implement an automation of the production operations of the firearm.

In a variant of the invention, each clamping element of the pair of clamping elements is housed inside the frame in a sliding manner between a position in which a first end part of the clamping element protrudes towards a housing seat of the barrel group located at a front portion of the frame and a position in which the first end part is retracted and substantially does not protrude into the housing seat of the barrel group.

Advantageously, such positioning allows to pass from a locking condition of the barrel group in which the first end part is positioned so as to be able to engage a portion of the barrel group, for example a hook, to a condition in which the release of the barrel group is ensured in the absence of jamming or blockages.

In a variant of the invention, the closing device comprises a maneuvering group configured to impart to each clamping element of the pair of clamping elements a force in opposition to a force exerted by a buffer on the respective clamping element.

In one embodiment of the invention, wherein the maneuvering group comprises an actuation element arranged externally to the frame, wherein the actuation element is made as an opening lever and is coupled to an upper end of a control shaft housed internally to the frame in a rotatable manner about a rotation axis, wherein a lower end of the control shaft is coupled to each of the pair of clamping elements, so that a rotation of the control shaft imparted through the lever actuation element causes a translation of the clamping elements in opposition to the force exerted by the respective buffer.

Preferably, the lower end of the control shaft comprises:

- a first peg configured to engage a seat made in a first clamping element of the pair of clamping elements; and
- a second peg configured to cooperate with an arm pivoted on the frame, wherein the arm engages a second clamping element of the pair of clamping elements.

Advantageously, the embodiment with lever actuation element ensures that with a rotational movement of the same, the control shaft acts uniformly on both clamping elements, applying an opposing substantially coaxial to the thrust force of the buffers. In this way, no moments are created on the clamping element that could lead to wear or degradation of the seat thereof.

In one embodiment of the invention, the maneuvering group comprises an actuation element arranged externally to the frame, wherein the actuation element is made as a slider movable in translation in the direction of a front portion of the frame and is coupled to a lever mechanism inside the frame that engages the pair of clamping elements, so that an advancement of the slider actuation element towards the front portion of the frame causes a translation of the pair of clamping elements in opposition to the force exerted by the respective buffers.

Advantageously, also the embodiment with slider actuation element ensures that the lever mechanism acts uniformly on both clamping elements, applying an opposing substantially coaxial to the thrust force of the buffers. In this way, no moments are created on the clamping element that could lead to wear or degradation of the seat thereof.

Preferably, the lever mechanism cooperates with a releasable locking rod housed in the frame movably along its own rod axis and configured to retain the lever mechanism in an engagement position corresponding to a position of maximum translation of the pair of clamping elements in opposition to the force exerted by the respective buffers.

Advantageously, the locking rod reliably ensures that the lever mechanism maintains the engagement position at which the pair of clamping elements is maintained in a maximum backward configuration from the housing seat of the barrel group.

More preferably, the releasable locking rod cooperates with a release rod housed in the frame movably along its own rod axis, between a configuration of greater protrusion from the frame at the housing seat of the barrel group in which it does not cooperate with the releasable locking rod and a configuration of lesser or no protrusion from the housing seat of the barrel group in which it cooperates with the releasable locking rod to disengage it from the lever mechanism.

Advantageously, thanks to the protrusion condition of the release rod from the housing seat, said release rod is actuated by the barrel group itself, when the latter is returned to the closed configuration in which it engages said seat. In this way, therefore, by returning the barrel group to the closed position, there is an automatic release of the lever mechanism from the locking rod.

BRIEF DESCRIPTION OF THE DRAWINGS

Further characteristics and advantages of the present invention will become clearer from the following detailed description of some preferred embodiments thereof, made with reference to the appended drawings.

The different features in the individual configurations can be combined with each other as desired according to the following description, if the advantages resulting specifically from a particular combination are to be availed of.

In such drawings:

FIG. 1 is a perspective view of a first preferred embodiment of a firearm according to the present invention;

Figure 1:
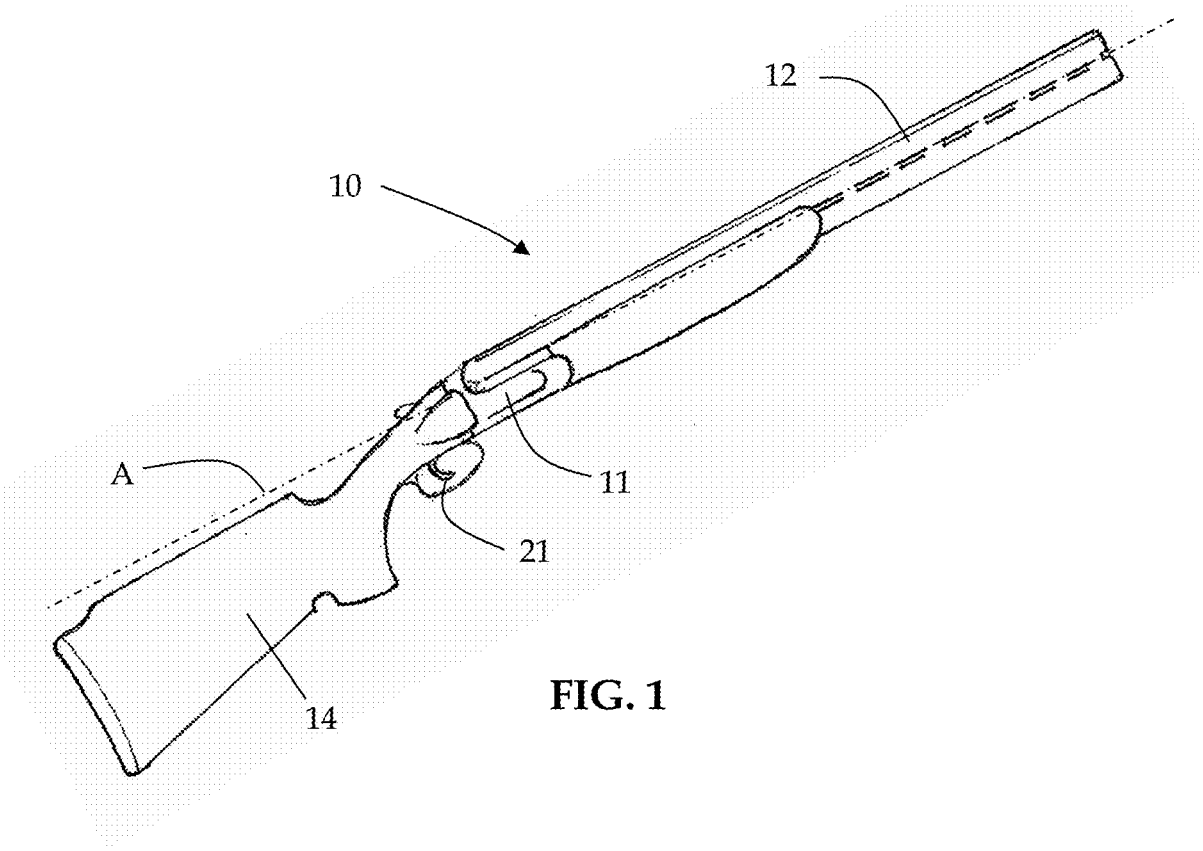
Figure 2A:
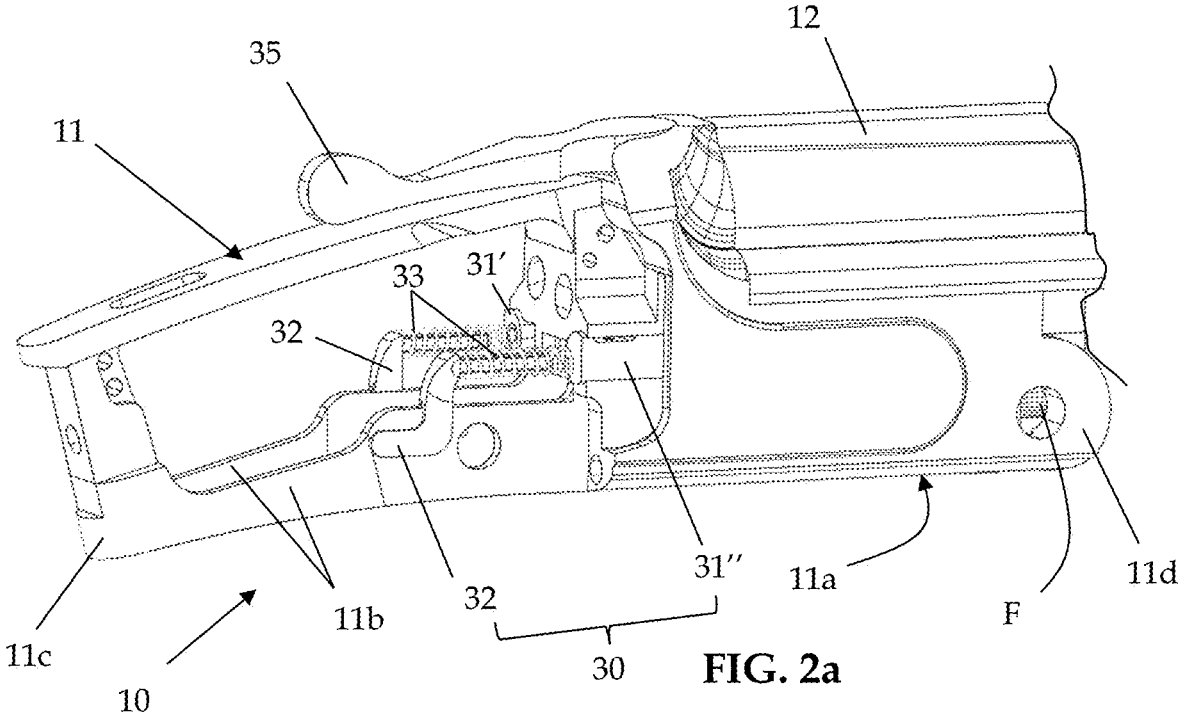
Figure 2B:
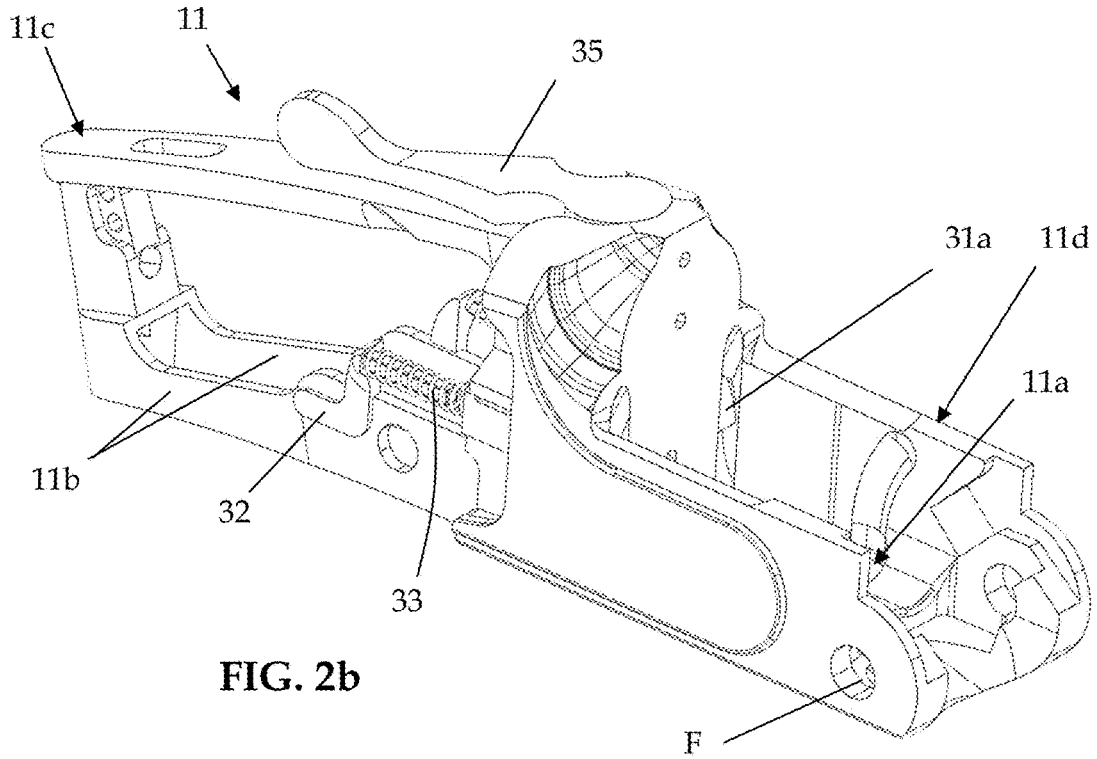
Figure 3:
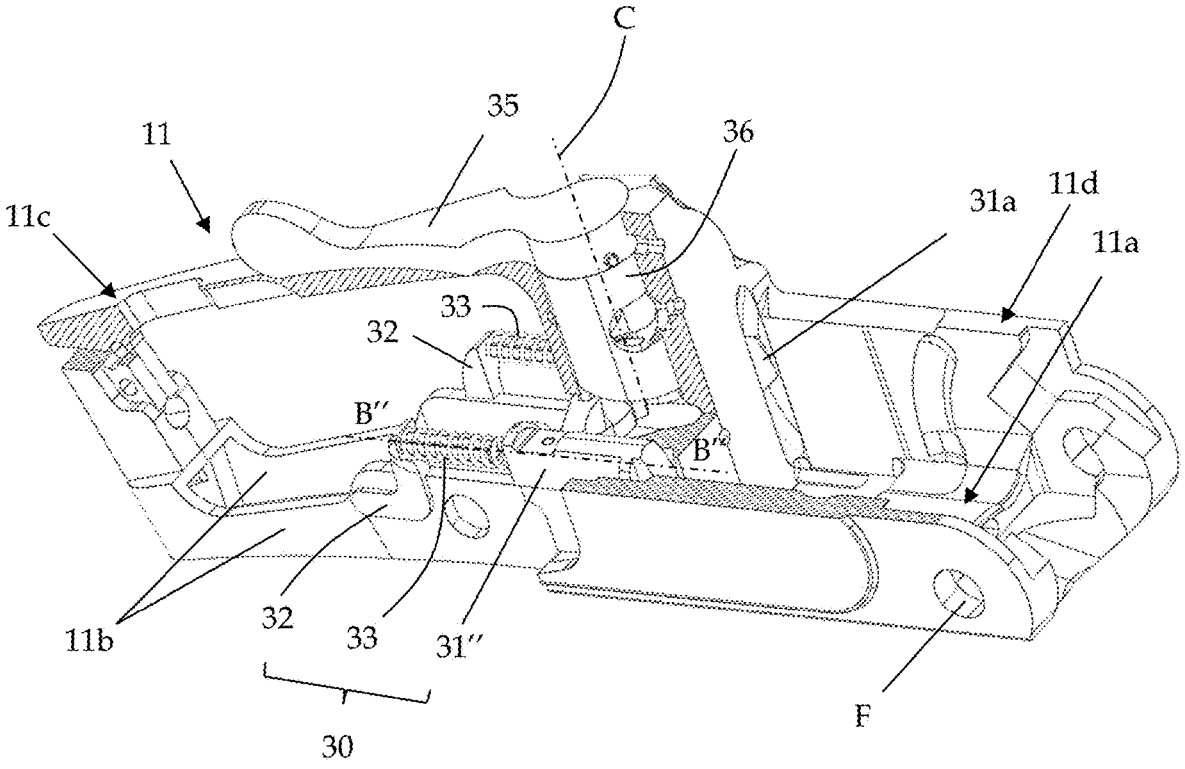
Figure 4:
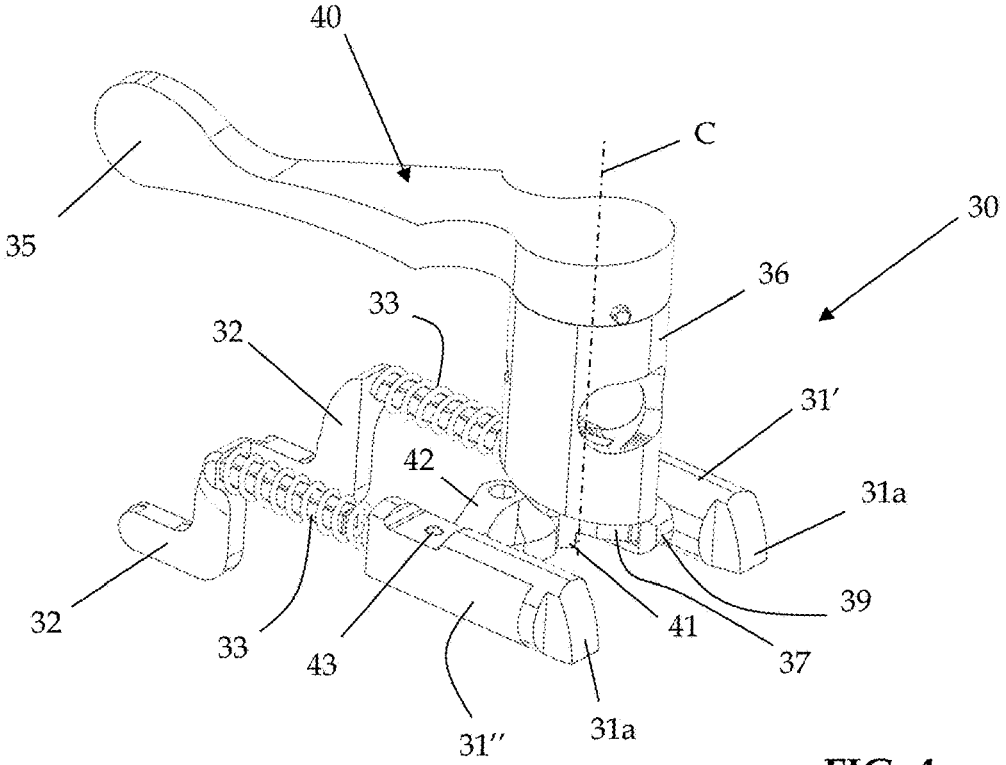
Figure 5:
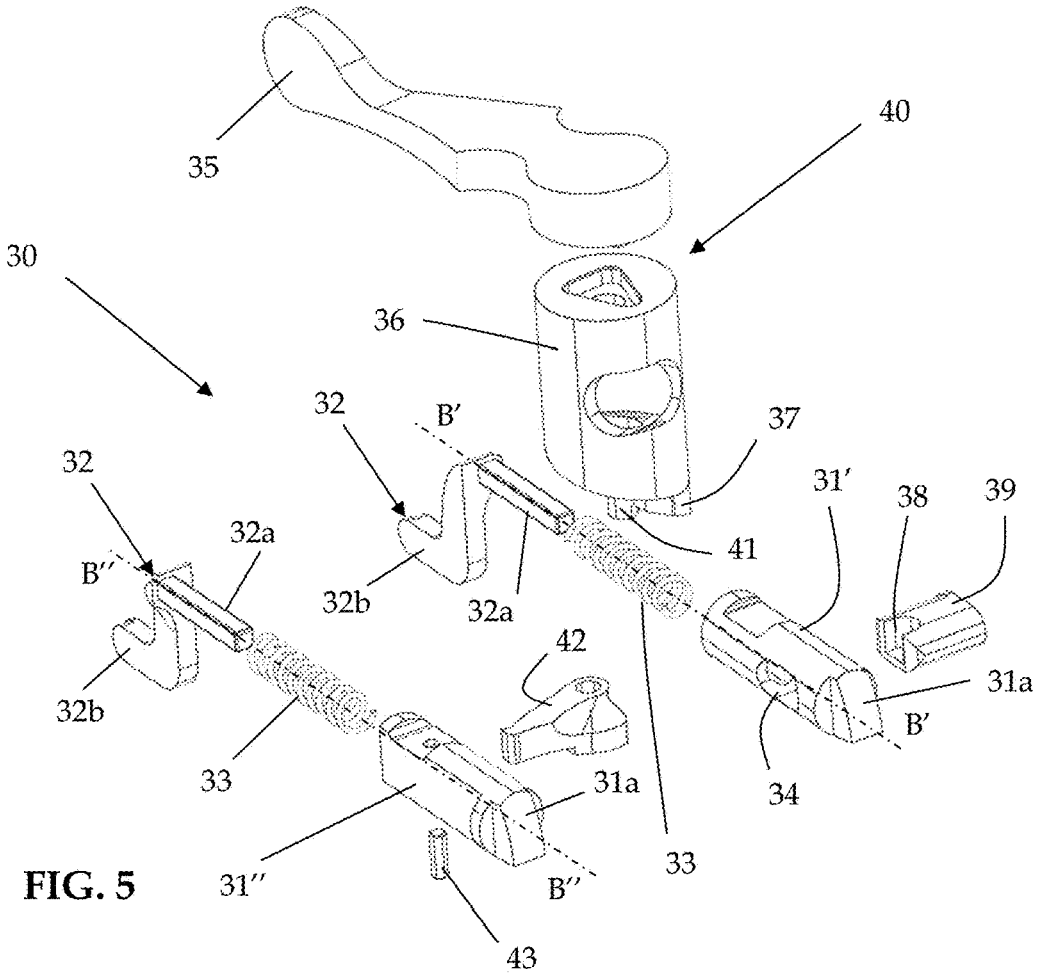
Figure 6:
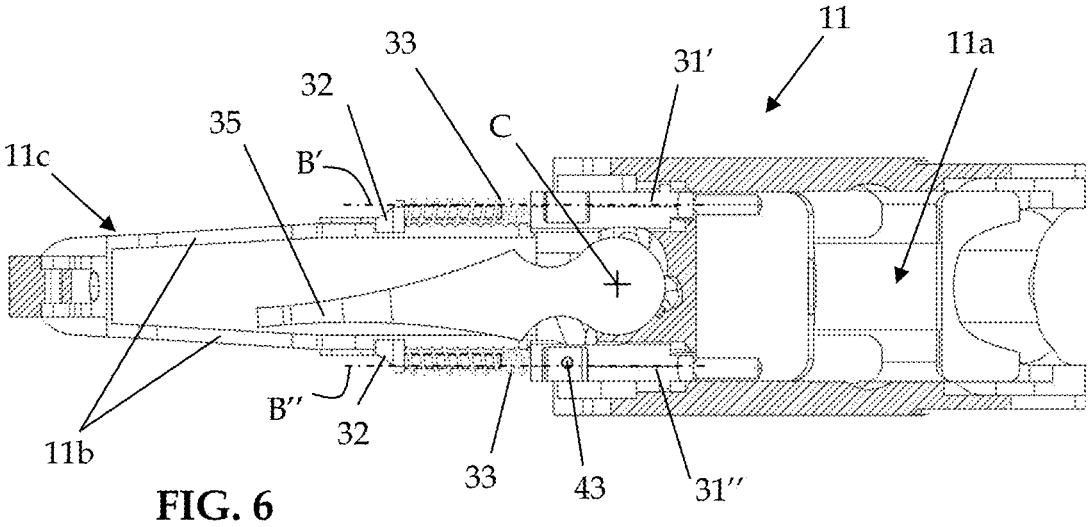
Figure 7:
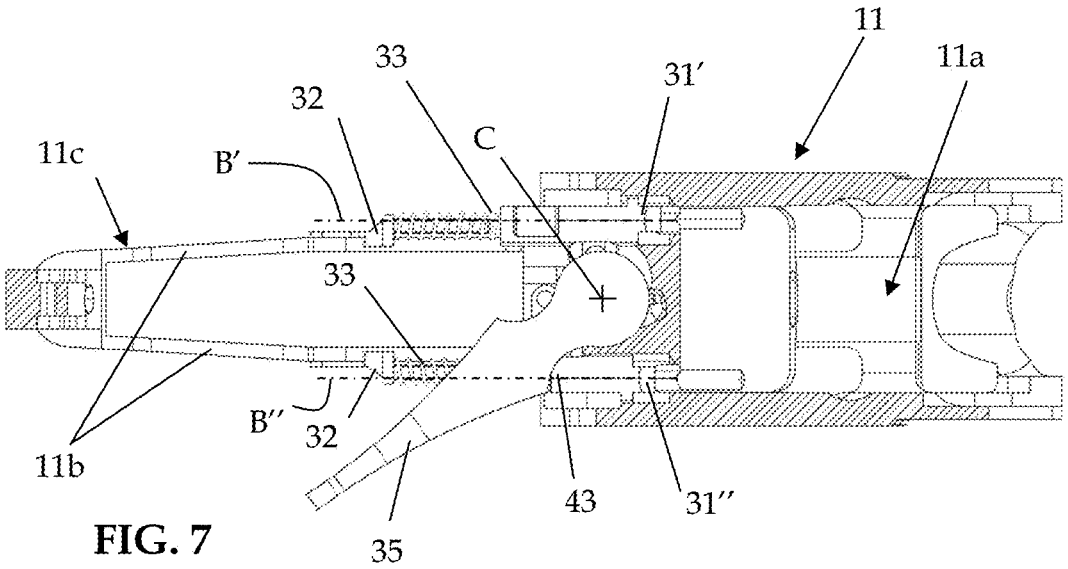
Figure 8A:
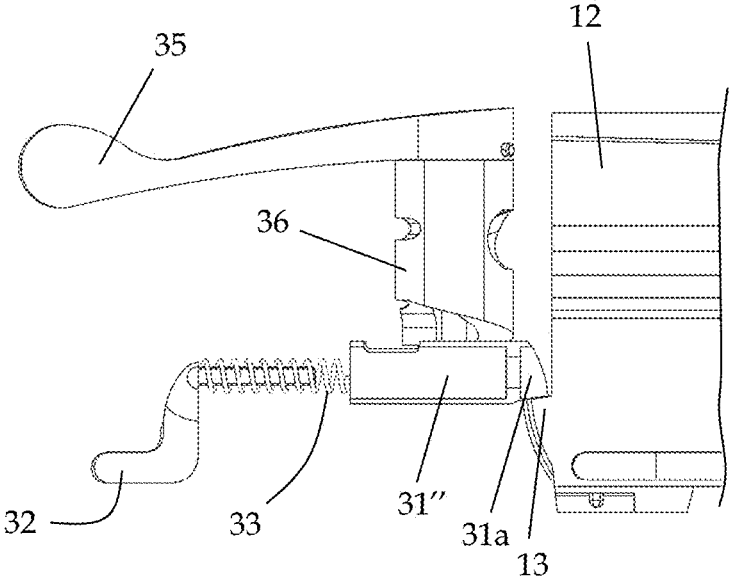
Figure 8B:
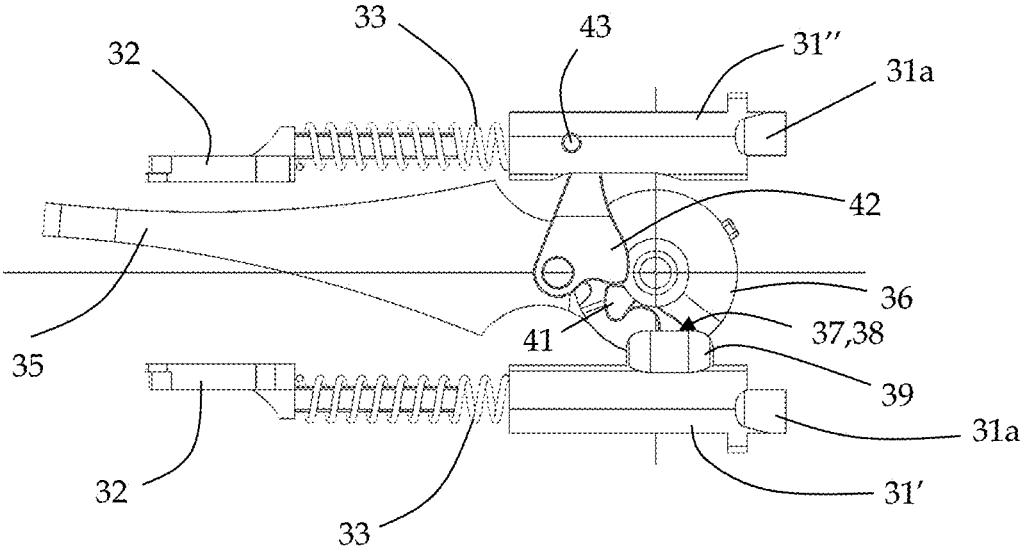
Figure 9A:
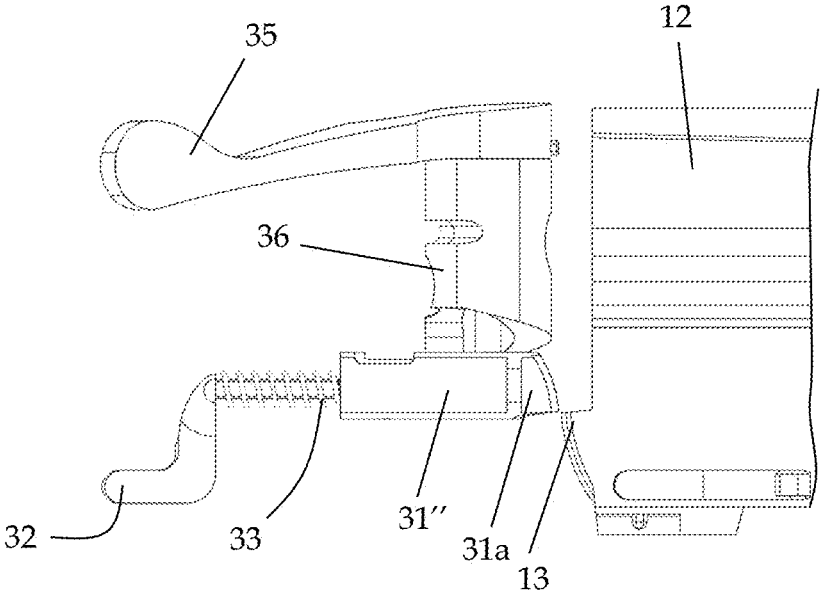
Figure 9B:
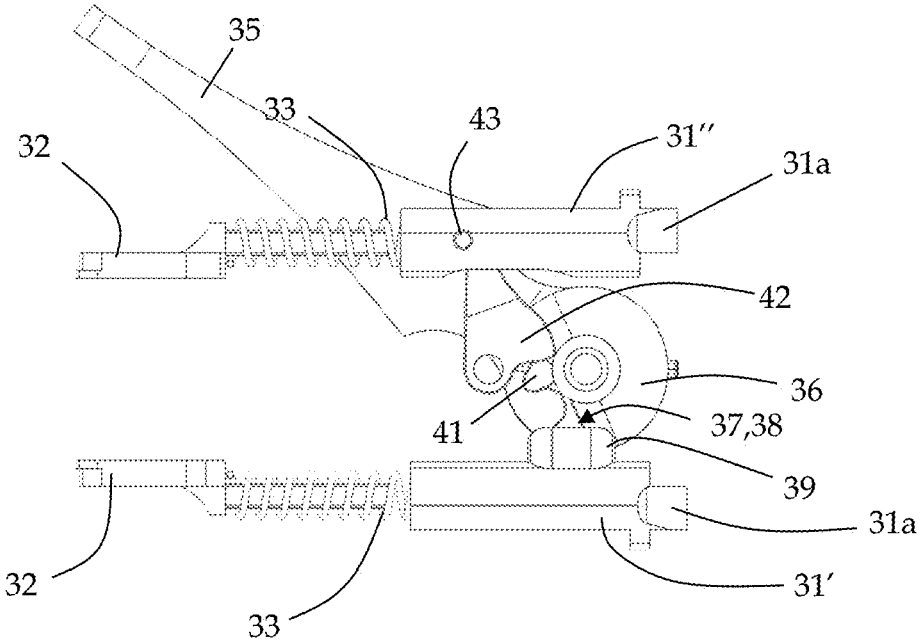
Figure 10:
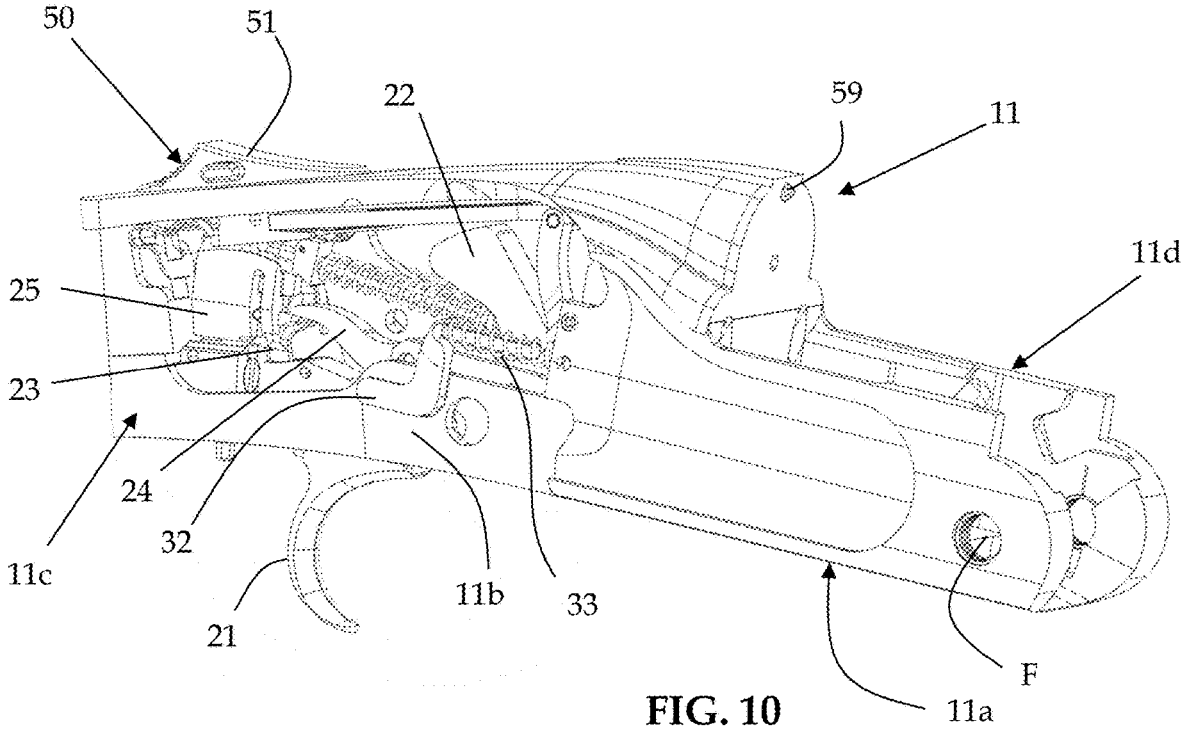
Figure 11:
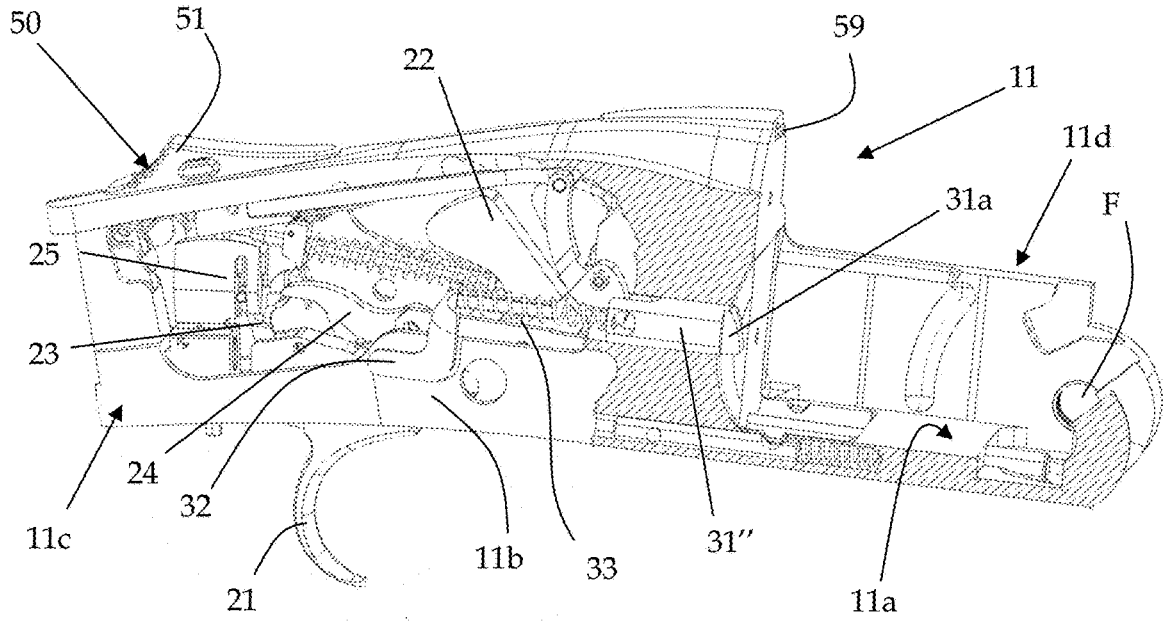
Figure 12:
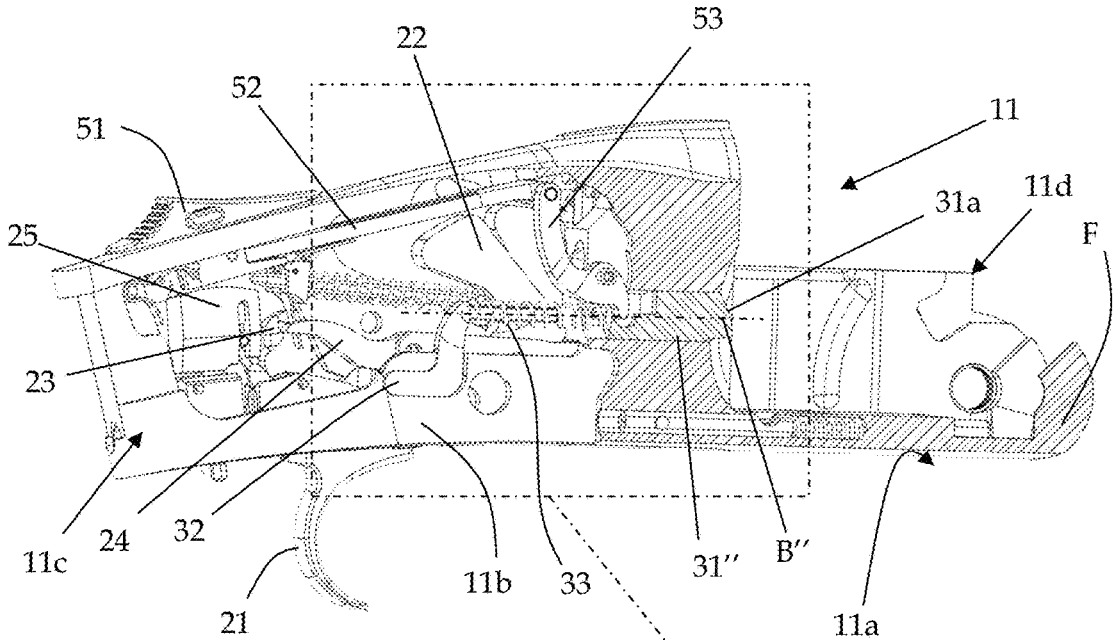
Figure 12A:
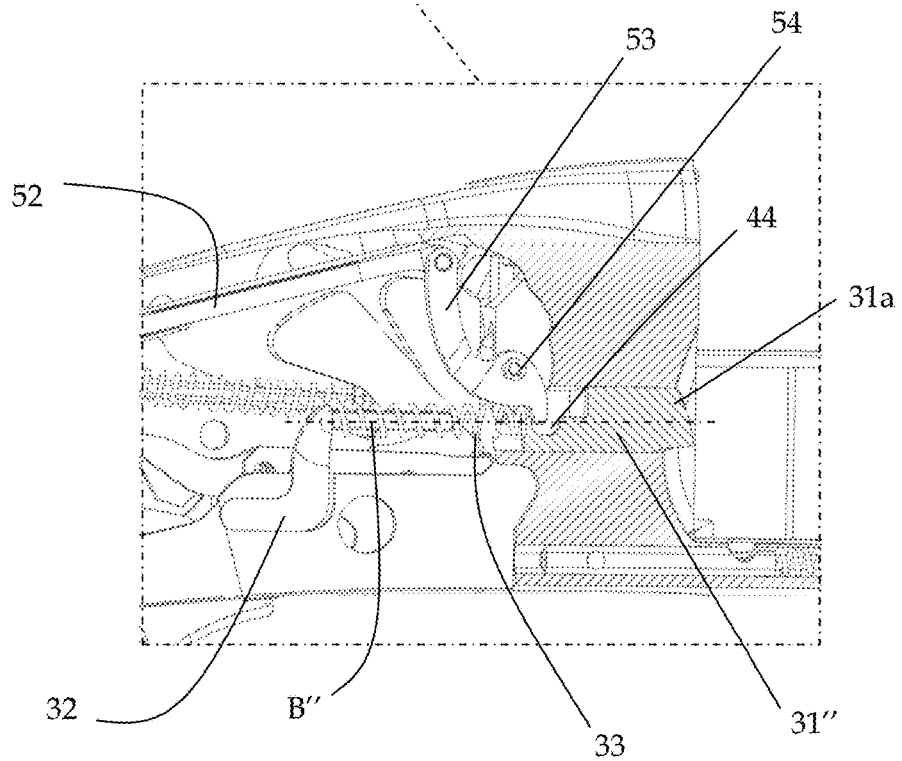
Figure 13:
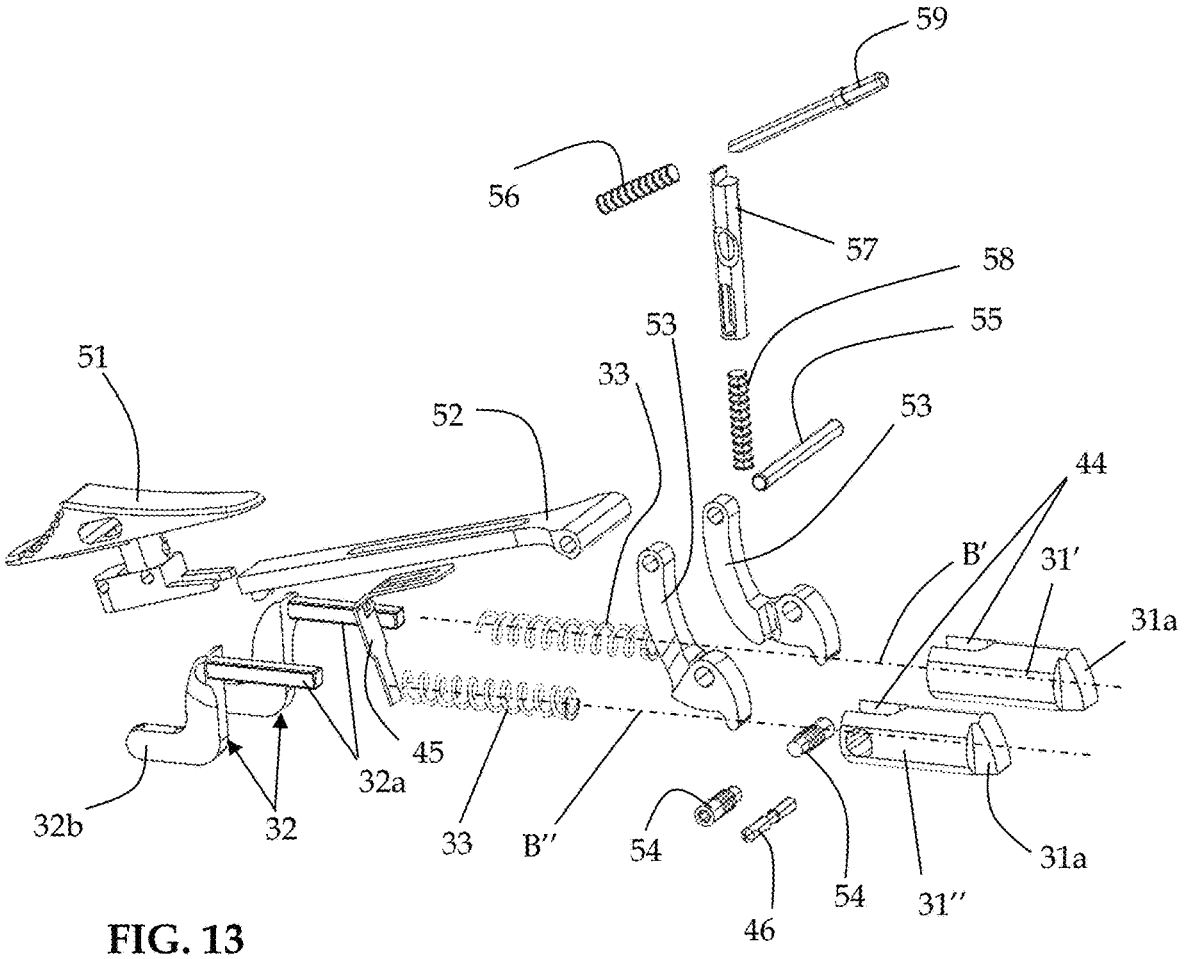
Figure 14:
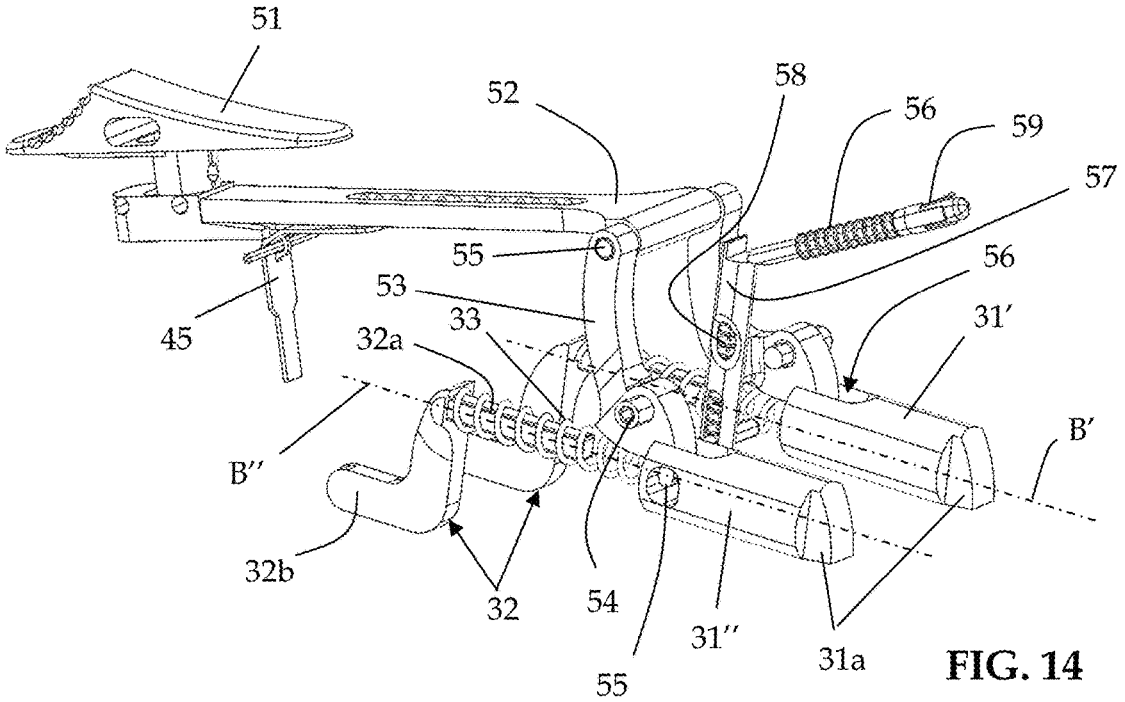
Figure 15A:
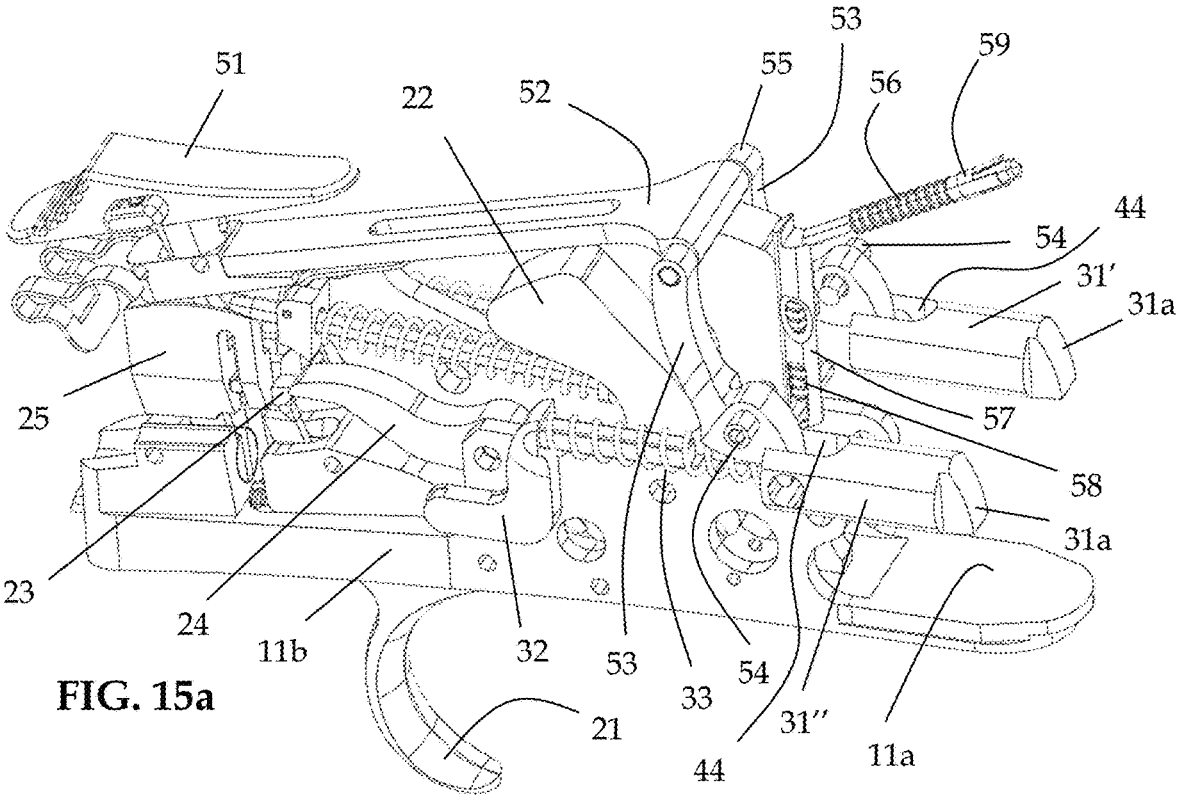
Figure 15B:
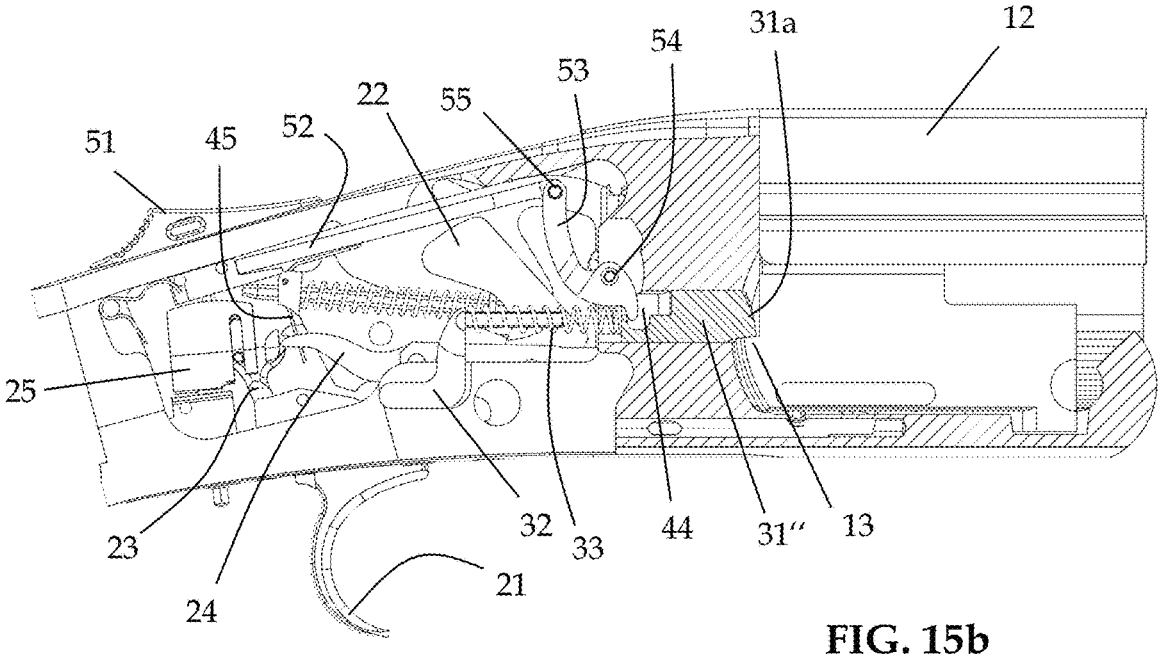
Figure 16A:
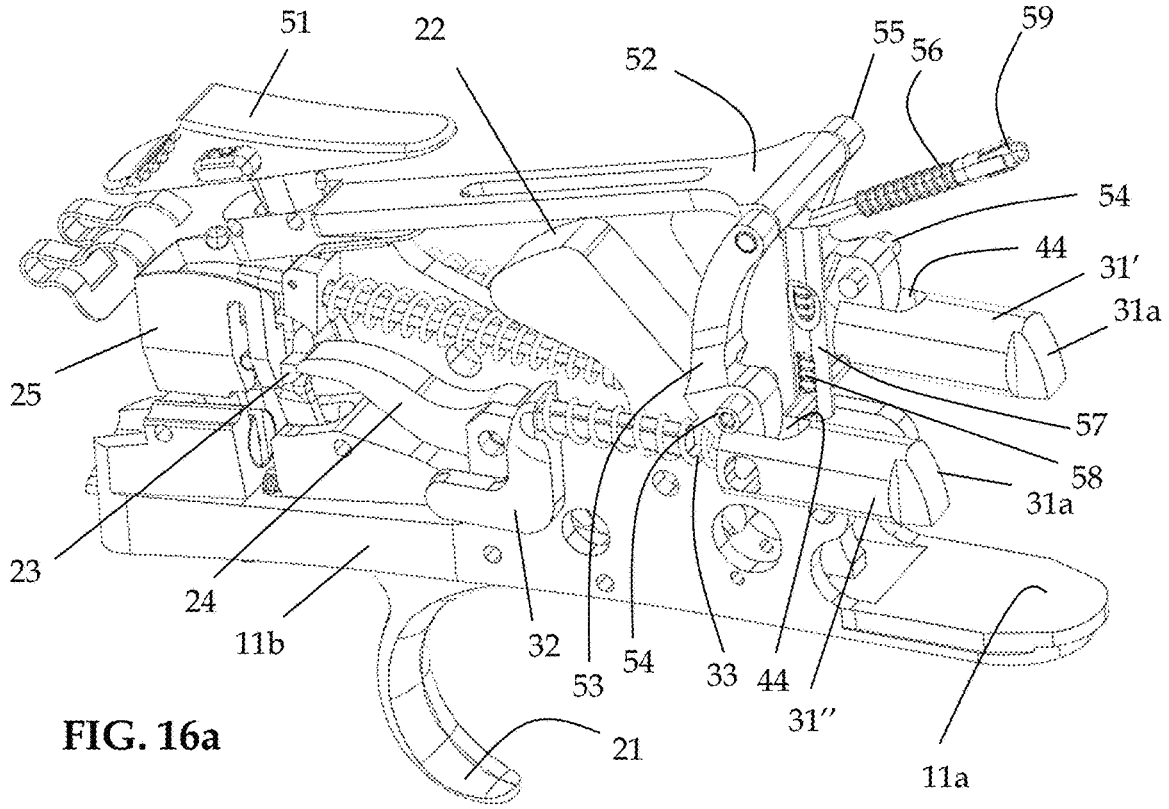
Figure 16B:
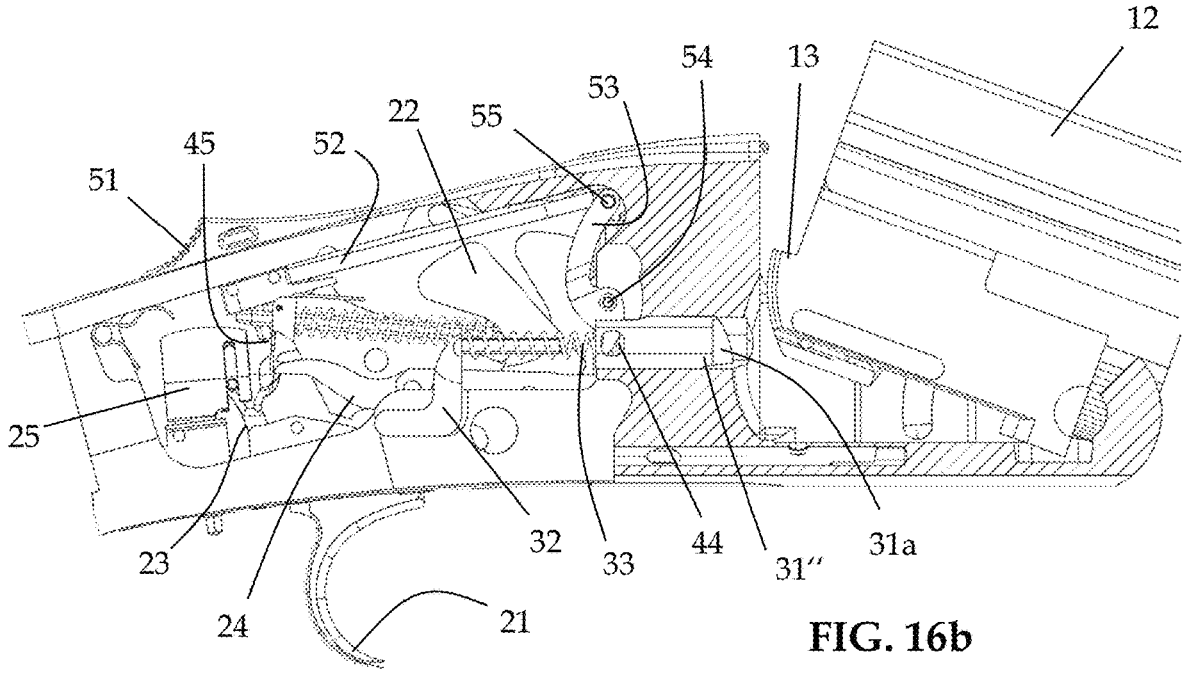

FIGS. 2*a* and 2*b* are perspective views of the frame of the firearm of FIG. 1 provided with the closing device, respectively with mounted barrel group, of which only a portion is shown, and without mounted barrel group;

FIG. 3 is a perspective sectional view both along a vertical plane and along a horizontal plane of the frame of the firearm of FIG. 1 with the closing device mounted;

FIG. 4 is a perspective view of the closing device of the firearm of FIG. 1;

FIG. 5 is an exploded perspective view of the closing device of FIG. 4;

FIG. 6 is a partially sectioned plan view of the frame of the firearm of FIG. 1 with the closing device mounted, in the closed configuration;

FIG. 7 is a partially sectioned plan view of the frame of the firearm of FIG. 1 with the closing device mounted in the open configuration;

FIGS. 8*a* and 8*b* are, respectively, a side elevation view of the closing device in engagement with the barrel group and a bottom view of said closing device, both in the closed configuration;

FIGS. 9*a* and 9*b* are, respectively, a side elevation view of the closing device in engagement with the barrel group and a bottom view of said closing device, both in the open configuration FIG. 10 is a partial perspective view of a second preferred embodiment of a firearm according to the present invention in which only the frame with a mounted closing device is shown;

FIG. 11 is a perspective sectional view along a first vertical plane of the parts of the firearm shown in FIG. 10;

FIGS. 12 and 12*a* are, respectively, a perspective sectional view along a second vertical plane of the parts of the firearm shown in FIG. 10, and an enlarged detail thereof;

FIG. 13 is a perspective exploded view of the closing device of the firearm of FIG. 10;

FIG. 14 is a mounted perspective view of the closing device of the firearm of FIG. 10;

FIGS. 15*a* and 15*b* are, respectively, a perspective view with some parts removed for clarity of illustration, and a sectioned view in side elevation, of the frame of the firearm of FIG. 10 with the closing device in the closed configuration; and FIGS. 16*a* and 16*b* are, respectively, a perspective view with some parts removed for clarity of illustration, and a sectioned view in side elevation, of the frame of the firearm of FIG. 10 with the closing device in the open configuration.

DETAILED DESCRIPTION OF THE INVENTION

For the illustration of the drawings, use is made in the following description of identical numerals or symbols to indicate construction elements with the same function. Moreover, for clarity of illustration, certain references may not be repeated in all drawings.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The use of "for example", "etc.", "or" indicates non-exclusive alternatives without limitation unless otherwise indicated. The use of "comprises" and "includes" means "comprises or includes, but not limited to", unless otherwise indicated.

In addition, measurements, values, shapes and geometric references (such as perpendicularity and parallelism), when associated with words such as "about" or other similar terms such as "almost" or "substantially", are to be understood as "unless there are measurement errors" or "unless there are inaccuracies due to production and/or manufacturing errors" and, above all, "unless there is a slight deviation from the value, measurement, shape or geometric reference to which it is associated".

Moreover, the use of terms such as "first", "second", "main" and "secondary" does not necessarily identify an order, a relationship priority or relative position; these terms can simply be used to distinguish between similar components.

Last but not least, relative positioning terms such as "upper", "lower", "front", "rear" or "side" generally refer to the normal configuration of use, in this specific case to the grip configuration of the firearm in order to proceed with shooting.

With reference to FIGS. 1-9*b*, a first preferred embodiment of a firearm according to the present invention is illustrated, overall indicated as firearm 10.

The firearm 10, hereinafter for brevity's sake also "weapon 10", comprises a frame 11 to which a stock 14 and a barrel group 12, illustrated in FIG. 1 are mounted. The stock 14 is mounted integrally with the frame 11, while the barrel group 12 is mounted on the frame 11 in a tilting manner between a closed position in which the barrel group 12 is partially housed in a seat defined at an front portion 11*d* of the frame 11 and extends in parallel to a base wall 11*a* of the frame 11, and an open position in which the barrel group 12 is rotated with respect to the base of the frame 11. In other words, the frame 11 identifies a fulcrum F around which the barrel group 12 is hinged.

The barrel group 12 comprises at least one barrel extending along a longitudinal development axis A of the barrel. By way of example, but not limitation, in the illustrated embodiments, the barrel group 12 comprises two overlapping barrels extending along the longitudinal development axis A. However, in alternative embodiments, the barrel group may comprise a single barrel or two side-by-side barrels.

The frame 11 houses therein a trigger device configured to trigger the firing of a cartridge and a closing device 30 configured to selectively prevent the barrel group 12 from tilting with respect to the frame 11. For clarity of illustration, FIGS. 2*a*, 2*b* and 3 show the frame 11 provided only with the closing device 30.

By way of example, the trigger device (shown with reference to the embodiment of FIGS. 10-16) comprises at least one trigger 21 movably mounted (e.g., rotatable or translatable) on the frame 11 to actuate a group of trigger elements (shown in detail in FIGS. 15*a*-16*b*) connected in chain and configured to act on at least one firing pin (not illustrated). In the embodiment of FIGS. 15*a*-16*b*, the group of trigger elements comprises a release 23 stabilized by a mass 25 and configured to move at least one sear 24, which in turn actuates a respective hammer 22 to act on a respective firing pin.

The closing device 30 is configured to act between the frame 11 and the barrel group 12, when the firearm 10 is in the closed configuration; in particular, the closing device 30 is maneuverable between a locking position (shown in detail in FIGS. 6, 8*a* and 8*b*), in which it engages the barrel group 12 to prevent the tilting thereof with respect to the frame 11, and a release position (shown in detail in FIGS. 7, 9*a* and 9*b*), in which the closing device 30 is disengaged from the barrel group 12 and the barrel group 12 is therefore free to rotate with respect to the frame 11.

In a preferred embodiment illustrated in detail in FIGS. 4 and 5, the closing device 30 comprises at least one pair of independent and separate from each other clamping elements 31',31" with longitudinal development.

As shown in FIG. 3, the clamping elements 31',31" are at least partially received internally to the frame 11. The clamping elements 31',31" develop along a respective development axis B',B" of the clamping elements and are slidably received within the frame 11, along their own longitudinal development axis B',B".

In particular, the clamping elements 31',31" are housed inside the frame 11 in a sliding manner between a position in which a first end part 31*a* of the clamping element 31',31" protrudes towards a housing seat of the barrel group 12 located at the front portion 11*d* of the frame and a position in which the first end part 31*a* is retracted and substantially does not protrude into the housing seat of the barrel group 12.

Consequently, when the barrel group 12 is in the closed position, the clamping elements 31',31" engage a respective hook 13 made on the barrel group 12, as shown in FIG. 8*a*, each with its own first end part 31*a*, preferably shaped like a tip.

The closing device 30 also comprises a pair of buffers 32, 33 each mounted on a respective side 11*b* of the rear portion 11*c* of the frame 11. Each buffer 32, 33 comprises a support 32 carrying a first elastic element 33, interposed between the support 32 and a respective clamping element 31',31" and exerting an axial thrust force on the respective clamping element 31',31" substantially in parallel to and/or substantially along the longitudinal development axis B',B" thereof, so that, in the absence of applied forces, the clamping elements 31',31" protrude from the frame 11 with their first end part 31*a*, towards the housing seat of the barrel group 12.

Referring also to FIG. 5, the supports 32 of the buffers have a substantially S- or Z-shaped conformation or, more generally, have a first upper shank 32*a* and a second lower shank 32*b*. The first upper shank 32*a* is shaped to carry and/or cooperate with the first elastic element 33 so that the first elastic element 33 is suitably arranged to exert on a respective clamping element 31',31" the thrust force in parallel to and/or substantially along the longitudinal development axis B',B" of the clamping element 31',31". The second lower shank 32*b* is shaped to engage in a seat (not illustrated) made on the side 11*b* of the rear portion of the frame and ensure a stable coupling between the support 32 of the buffer and the frame 11, for example the second lower shank 32*b* hooks said seat by shape coupling as shown in FIG. 2*b*.

The upper shank 32*a* is shaped so as to counteract a thrust exerted along the longitudinal development direction of the respective clamping element 31',31" in opposition to the force exerted by the first elastic element 33. Advantageously, each buffer 32,33 is shaped to exert on the respective clamping element 31',31" a force substantially linear and parallel to the longitudinal development axis B',B" of the clamping element 31',31" itself. In this way, the wear of the clamping element 31',31", as well as of the seat in which it is housed are reduced to a minimum.

The closing device 30 further comprises a maneuvering group 40, 50 configured to impart to each clamping element 31',31" of the pair of clamping elements a force in opposition to a force exerted on each clamping element 31',31" by the respective buffer 32, 33.

In the embodiment of FIGS. 1-9*b* the maneuvering group 40 comprises an actuation element made as an opening lever 35, also known in the sector as a "lever", arranged externally to the frame, at the rear portion 11*c* of the frame, and coupled to an upper end of a control shaft 36 housed internally to the frame 11 in a rotatable manner about a rotation axis C. A lower end of the control shaft 36 is coupled to each of the clamping elements 31',31", so that a rotation of the control shaft 36 imparted through the opening lever 35 causes a translation of the clamping elements 31',31" in opposition to the force exerted by the respective first elastic element 33.

In particular, the lower end of the control shaft 36 comprises a first peg 37 configured to engage a seat 38 made on an insert 39 in turn configured to engage a first clamping element 31'. To this end, the first clamping element 31' comprises a through hole 34 complementary to the insert 39 and configured to receive it therein in the substantial absence of plays. In alternative embodiments not illustrated, the seat 38 is made directly on the first clamping element 31' or on an element integral thereto.

In this way, when the control shaft 36 is brought into rotation by actuating the opening lever 35, the first peg 37 transfers to the first clamping element 31' a substantially longitudinal thrust exerted in proximity to the longitudinal development axis B' of the first clamping element 31'.

The lower end of the control shaft 36 further comprises a second peg 41 configured to cooperate with a profile made at a first end of an arm 42 pivoted on the frame 11. A second end of the arm 42 engages a first pin 43 housed in a cavity (not illustrated) made on a second clamping element 31". In this way, when the control shaft 36 is brought into rotation, by acting on the opening lever 35, the second peg 41 cooperates with the profile of the pivoted arm 42, bringing the arm 42 into rotation. The rotation of the arm 42 causes on the first pin 43 a tangential thrust along a direction substantially coinciding with the longitudinal development axis B" of the second clamping element 31".

In this way, therefore, a rotation of the control shaft 36 about the rotation axis C cause on both clamping elements 31',31" the application of a substantially linear thrust force, substantially at the height of the respective development axis B',B". These forces lead both clamping elements 31',31" to move backward, retracting the respective first end part 31*a* and decoupling it from the corresponding hook 13.

FIGS. 10-16*b* show a second preferred embodiment of a firearm according to the present invention which differs from the first embodiment, in particular for the maneuvering group 50 of the closing device 30.

FIG. 10 shows the frame 11 of the second embodiment housing therein the trigger device and the closing device 30. As described in relation to the first embodiment, the trigger device comprises at least one trigger 21 configured to actuate a group of trigger elements connected in chain and configured to act on at least one firing pin (not illustrated). In exemplary terms, the group of trigger elements comprises a release 23 stabilized by means of a mass 25 and configured to move at least one sear 24, which in turn actuates a respective hammer 22 to act on a respective firing pin.

Similar to the first embodiment, the closing device 30 is configured to act between the frame 11 and the barrel group 12 (shown in FIGS. 15*b* and 16*b*), when the firearm 10 is in the closed configuration; in particular, the closing device 30 is maneuverable between a locking position (shown in detail in FIGS. 15*a* and 15*b*), in which the barrel group 12 engages to prevent the tilting thereof with respect to the frame 11, and a release position (shown in detail in FIGS. 16*a* and 16*b*), in which the closing device 30 is disengaged from the barrel group 12 and the barrel group 12 is therefore free to rotate with respect to the frame 11.

Also in the preferred embodiment of FIGS. 13 and 14, the closing device 30 comprises at least one pair of clamping elements 31',31" with longitudinal development independent and separate from each other. As shown in FIGS. 11, 12 and 12*a*, the clamping elements 31', 31" are at least partially received internally to the frame 11. The clamping elements 31',31" develop along a respective development axis B',B" of the clamping elements and are slidably received within the frame 11, along their own longitudinal development axis B',B".

In particular, when the barrel group 12 is in the closed position (shown in FIGS. 15*a* and 15*b*), the clamping elements 31',31" engage, each with its own first end part 31*a*, preferably shaped like a tip, a respective hook 13 made on the barrel group 12, shown in FIG. 15*b*.

In line with what is described in relation to the first embodiment, the closing device 30 comprises a pair of buffers 32, 33 in turn each comprising a support 32 mounted on a respective side 11*b* of the rear portion 11*c* of the frame 11 and a first elastic element 33. Each support 32 supports the first elastic element 33 in a position interposed between the support 32 and a respective clamping element 31',31" and so that the first elastic element 33 exerts on the respective clamping element 31',31" a linear thrust force substantially parallel and/or substantially along the longitudinal development axis B',B" of the clamping element 31',31".

The maneuvering group 50 of the closing device 30 of the firearm in accordance with the second embodiment comprises an actuation element made as a slider 51 arranged externally to the frame 11 at the rear portion 11*c* of the frame and movable in translation in the direction of the front portion 11*d* of the frame. The slider 51 is coupled to a first lever 52 of a lever mechanism 52, 53 inside the frame 11 so as to advance it towards the front portion 11*d* of the frame 11 up to an engagement position. In the engagement position, the first internal lever 52 engages a releasable locking rod 57 configured to retain the first internal lever 52 in the advanced engagement position.

The first internal lever 52 is in turn hinged to a pair of second internal levers 53 of the lever mechanism 52, 53 at a first end thereof. In particular, the first internal lever 52 is coupled to the second internal levers 53 so that an advancement of the first internal lever 52 towards the engagement position causes a rotation of the second internal levers 53 around a pivot 55 and at the same time around a respective fulcrum pin 54 placed in an intermediate position with respect to the extension of the respective second internal lever 53.

Each of the second internal levers 53 engages, at its own second end, a respective clamping element 31',31" so that, when the second internal levers 53 are brought into rotation by the advancement of the first internal lever 52, the clamping elements 31',31" are made to translate in opposition to the force exerted by the respective buffer 32, 33. In this way both clamping elements 31',31" move backward, retracting the respective first end part 31*a* and decoupling it from the corresponding hook 13.

To this end, the second end of each second internal lever 53 engages a groove 44 located at a second end part of the respective clamping element 31',31" opposite the first 31*a* so as to drag said clamping element 31',31" into translation when the second internal lever 53 is brought into rotation.

The releasable locking rod 57 is housed in the frame 11 according to an arrangement substantially orthogonal to the base wall 11*a* of the frame 11 and movably along its own rod axis. The releasable locking rod 57 is normally kept in a position away from the base wall 11*a* by a second elastic element 58 and is guided in its translation by a second pin 46 which also acts as an end-of-stroke. The advancement movement of the first internal lever 52 causes a temporary displacement of the releasable locking rod 57 towards the base wall 11*a*, which takes on again the distanced position once the first internal lever 52 reaches the engagement position. In such a configuration, the locking rod 57 retains the first internal lever 52 in the engagement position. In fact, the first internal lever 52 is in abutment against a step portion obtained at a free end of the locking rod 57.

In order to release the first internal lever 52 from the engagement position, the closing device 30 comprises a release rod 59, housed in the frame 11 according to an oblique arrangement with respect to the base wall 11*a* of the frame 11 and movably along its own rod axis, between a configuration of greater protrusion from the frame 11 at the housing seat of the barrel group 12 (shown in FIGS. 10 and 11) and a configuration of lesser or no protrusion. When brought into the position of lesser or no protrusion, the release rod 59 engages the releasable locking rod 57, displacing it from the distanced position and releasing in this way the first internal lever 52 from this locking rod 57.

The release rod 59 is normally held in the position of greater protrusion by a third elastic element 56 and is brought into the position of lesser or no protrusion by the barrel group 12, when this engages its own housing seat provided at the front portion 11*d* of the frame. In this way, advantageously, by bringing the barrel group 12 into the closed position there is an automatic release of the first internal lever 52 from the locking rod 57. The clamping elements 31',31" are therefore no longer forced by the set of internal levers 52, 53 in the position with the first end part 31*a* retracting; on the contrary they are returned by the respective first elastic elements 33 into the protruding locking position, with coupling with the hooks 13 of the barrel group 12. This also results in an automatic return of the internal levers 52, 53 into the initial positions.

In order to ensure that in the open position of the barrel group 12 the trigger device is inoperative, the slider-like actuation element 51 comprises a lower portion shaped so as to cooperate with a safety element 45 arranged internally to the frame 11. The safety element 45 is made as a sheet metal and has an L-shaped profile. The safety element 45 is arranged in the frame in an oscillatable manner between a rest position in which the safety element 45 does not interfere with the group of trigger elements and a safety position in which it interferes with the group of trigger elements so as to make it inoperative. Advantageously, the slider-like actuation element 51 and the safety element 45 cooperate so that an advancement of the slider element 51 in the direction of the front portion 11*d* of the frame causes an oscillation of the safety element 45 such as to bring it into the safety position.

What is claimed is:

1. A firearm comprising at least:

a frame; and a barrel group comprising at least one barrel, the barrel group being mounted in a tilting manner with respect to the frame, wherein the frame houses at least one closing device configured to act between the frame and the barrel group so as to selectively prevent the barrel group from tilting with respect to the frame, wherein the closing device comprises:

at least one pair of clamping elements with longitudinal development independent of each other, the clamping elements being slidably housed inside the frame each along its own longitudinal development axis; and at least one pair of buffers each coupled to a respective clamping element so as to exert an axial thrust force on the respective clamping element substantially in parallel to and/or substantially along a respective longitudinal development axis.

2. The firearm according to claim 1, wherein each buffer of the pair of buffers comprises a support carrying a first elastic element interposed between the support and a respective clamping element.

3. The firearm according to claim 1, wherein each buffer of the pair of buffers is mounted on a respective side of a rear portion of the frame.

4. The firearm according to claim 1, wherein each clamping element of the pair of clamping elements is housed inside the frame in a sliding manner between a position in which a first end part of the clamping element protrudes towards a housing seat of the barrel group located at a front portion of the frame and a position in which the first end part is retracted and substantially does not protrude into the housing seat of the barrel group.

5. The firearm according to claim 1, wherein the closing device comprises a maneuvering group configured to impart to each clamping element of the pair of clamping elements a force in opposition to a force exerted by a buffer on a respective clamping element.

6. The firearm according to claim 5, wherein the maneuvering group comprises an actuation element arranged externally to the frame, wherein the actuation element is made as an opening lever and is coupled to an upper end of a control shaft housed internally to the frame in a rotatable manner about a rotation axis (C), wherein a lower end of the control shaft is coupled to each of the pair of clamping elements, so that a rotation of the control shaft imparted through the opening lever causes a translation of the clamping elements in opposition to the force exerted by a respective buffer.

7. The firearm according to claim 6, wherein the lower end of the control shaft comprises:

a first peg configured to engage a seat made in a first clamping element of the pair of clamping elements; and a second peg configured to cooperate with an arm pivoted on the frame, wherein the arm engages a second clamping element of the pair of clamping elements.

8. The firearm according to claim 5, wherein the maneuvering group comprises an actuation element arranged externally to the frame, wherein the actuation element is made as a slider movable in translation in the direction of a front portion of the frame and is coupled to a lever mechanism inside the frame that engages the pair of clamping elements, so that an advancement of the slider actuation element towards the front portion of the frame causes a translation of the pair of clamping elements in opposition to the force exerted by the respective buffers.

9. The firearm according to claim 8, wherein the lever mechanism cooperates with a releasable locking rod housed in the frame movably along its own rod axis and configured to retain the lever mechanism in an engagement position corresponding to a position of maximum translation of the pair of clamping elements in opposition to the force exerted by the respective buffers.

10. The firearm according to claim 9, wherein the releasable locking rod cooperates with a release rod housed in the frame movably along its own rod axis, between a configuration of greater protrusion from the frame at the housing seat of the barrel group in which it does not cooperate with the releasable locking rod and a configuration of lesser or no protrusion from the housing seat of the barrel group in which it cooperates with the releasable locking rod to disengage it from the lever mechanism.

11. The firearm according to claim 2, wherein the support comprises a first shank shaped to carry and/or cooperate with the first elastic element in exerting the axial thrust force and a second shank shaped to achieve a stable coupling to the frame.

* * * * *